US006186908B1

(12) United States Patent
Kawasaki et al.

(10) Patent No.: US 6,186,908 B1
(45) Date of Patent: Feb. 13, 2001

(54) RETRIEVAL APPARATUS FOR OPERATION-MANAGEMENT SYSTEM OF GOLF LINKS AND RETRIEVAL METHOD THEREFOR

(75) Inventors: Hiroaki Kawasaki; Nobuo Akiba, both of Mobara (JP)

(73) Assignee: Futaba Denshi Kogyo Kabushiki Kaisha, Mobara (JP)

( * ) Notice: Under 35 U.S.C. 154(b), the term of this patent shall be extended for 0 days.

(21) Appl. No.: 09/335,485

(22) Filed: Jun. 18, 1999

(30) Foreign Application Priority Data

Jun. 24, 1998 (JP) ..... 10-177794

(51) Int. Cl.[7] ..... A63B 71/06

(52) U.S. Cl. ..... 473/407; 473/131; 473/140; 473/406; 340/500; 340/539

(58) Field of Search ..... 700/92, 217; 340/500, 340/539, 571.2, 825.69, 825.72, 932.2, 988, 990, 993, 573, 691; 473/131, 140, 198, 406, 407; 364/400, 410.1; 455/5.1, 6.1, 6.3, 9, 95, 230, 404, 412

(56) References Cited

U.S. PATENT DOCUMENTS 4,480,310 * 10/1984 Alvarez ..... 700/217
4,799,062 * 1/1989 Sanderfofd, Jr. et al. ..... 342/450
4,926,161 * 5/1990 Cupp ..... 340/988
5,053,768 * 10/1991 Dix, Jr. ..... 340/988
5,095,430 * 3/1992 Bonito et al. ..... 700/92
5,324,028 * 6/1994 Luna ..... 473/169
5,610,586 * 3/1997 Zeytoonjian et al. ..... 340/571
5,664,880 * 9/1997 Johnson et al. ..... 473/407
5,719,555 * 2/1998 Zeytoonjian et al. ..... 340/571
5,797,809 * 8/1998 Hyuga ..... 473/407

* cited by examiner

*Primary Examiner*—Joe H. Cheng
*Assistant Examiner*—Carmen D. White
(74) *Attorney, Agent, or Firm*—Oblon, Spivak, McClelland, Maier & Neustadt, P.C.

(57) ABSTRACT

A retrieval apparatus for operation-management system of golf links and method therefor are, herein, disclosed. LED which is constructed as a display means of measurement results by a sensor is turned on in a given color on the basis of sensor ID detected by moving a moving vehicle on a cart route on which a retrieval apparatus is mounted. And, control on lighting of LED which is constructed as a display means of measurement results by a repeater is performed on the basis of repeater ID detected during moving of the moving vehicle.

7 Claims, 9 Drawing Sheets

LED DISPLAY COLOR
GREEN
GREEN
GREEN
YELLOW
GREEN
GREEN
GREEN
RED
GREEN
GREEN
RED
GREEN
GREEN

SENSOR ID
1
2
3
5
4
5
6
3
7
8
5
9
10
NORMAL
ABNORMAL 1
NORMAL
ABNORMAL 2
NORMAL
ABNORMAL 2
NORMAL

RETRIEVAL APPARATUS FOR OPERATION-MANAGEMENT SYSTEM OF GOLF LINKS AND RETRIEVAL METHOD THEREFOR

BACKGROUND OF THE INVENTION

This invention relates to a retrieval apparatus for operation-management system of golf links and retrieval method.

In recent years, a golf links has been known where a golf player operates for himself a cart for riding (hereinafter referred simply to as cart).

However, in this type of golf links, a player can not grasp the congestion in the course and delay of play until the player comes back to a clubhouse after finish of play when the player once starts from the start tee. Therefore, there is a golf links, for example, where a course guide is stationed every several holes in order to accelerate the play. However, this type of golf links has a problem that excessive personnel costs are required.

Then, as described, for example, in the specifications of Japanese Patent Application No. 9-31855 and Japanese Patent Application No. 10-28504 which were filed by the present Applicant himself, a management system has been kwon in which a transmit-receive means for a cart identification signal such as a cart ID and so forth is installed in the cart and a sensor is placed to a cart route which is a route of the cart, for example, in the vicinity of teeing ground, fairway, green and a cart identification signal which is detected by the sensor is controlled by a control office.

The system described in the above-mentioned specifications controls a standing position of each cart on the basis of the cart identification signal and identification signal of the sensor and controls, for example, time when the cart is detected by means of the sensor and displays them in a display unit, thereby the operation conditions of the carts which are on a course can be grasped. The result of communication between the cart and the sensor is transmitted to the control office via a repeater which is placed at given position in the golf links.

By the way, a manager of a golf links can grasp the operation conditions in the control office by carrying out communication with a cart.

However, in the case where a setting position of a sensor is not proper as a communication position due to problems such as design of the course and so forth or in the case where a setting of communication area of the sensor is not proper for given communication, a problem occurs that the cart receives at a certain position identification informations other than desired ones of the sensor. And, in the case, for example, where the sensor does not operate normally for any causes, for example, decline of a battery, a problem occurs that an identification information can not be obtained correctly at a specific position.

That is to say, the identification informations which are transmitted to the control office under the condition at which such the problems occur are deemed as different information from actual operation conditions.

The aforementioned facts are the same with respect to the repeater. That is to say, in the case where the setting position of the repeater is not proper as communication position and where the setting of communication area is not proper as required communication, problems occur that communication with the control office is hard and cart identification signal and sensor identification signal can not be transmitted regularly to the control office.

However, under the actual conditions using operation, it is not easy for the control office to judge on whether the identification information transmitted from the cart is correct or erroneous. Therefore, the control office performs operation-management on the basis of erroneous identification information, which affects adversely grasp of conditions of play in the golf links in its entirety. And, smooth play of a golf player who starts play on the basis of the erroneous operation-management information is hindered.

Then, it could be thought to measure the communication areas of the sensor and the repeater individually, which, however, requires an operational member for operating the cart at the time of measurement and a member for measuring and causes increases in measuring time and personnel costs.

SUMMARY OF THE INVENTION

According to a first aspect of this invention, there is provided with a retrieval apparatus for a golf links operation-management system which is provided with at least one repeater placed in the golf links, in which a first identification information is set individually and which can transmit said first identification information within a given area, at least one sensor placed at required positions along a cart route in said golf links, in which a second identification information is set individually and which can transmit said second identification information within a given area, and a moving vehicle on which a receiving means for receiving said first and second identification informations is mounted and which can patrol said cart route, in which said retrieval apparatus is characterized by comprising a judging means mounted to said moving vehicle for judging receiving conditions of said repeaters or sensors on the basis of said first and second identification informations received by said receiving means, a storage means mounted to said moving vehicle for storing judgement results by said judging means, and a display means mounted to said moving vehicle for performing required display corresponding to said receiving conditions on the basis of said judgement results by said judging means, and in which said display means is characterized by displaying lack or random order in said first and second identification informations on the basis of said judgement results by said judging means.

According to a second aspect of this invention, there is provided with a retrieval apparatus for a golf links operation-management system of the first aspect in which said judgment results stored in said storage means can be output to an external equipment.

According to a third aspect of this invention, there is provided with a retrieval apparatus for a golf links operation-management system of the first aspect of this invention in which said display means can display selectively identification numbers of said identification information.

According to a fourth aspect of this invention, there is provided with a retrieval apparatus for a golf links operation-management system of the first aspect of this invention which is further provided with a voice output means for performing the required voice output corresponding to said receiving conditions the basis of said judgement results by said judging means.

According to a fifth aspect of this invention, there is provided with a retrieval method for a golf links operation-management system which is provided with repeaters placed in the golf links and in which a first identification information is set individually and which can transmit said first identification information within a given area, sensors placed at required positions along cart route in said golf links and in which a second identification information is set individually and which can transmit said second identification information within a given area, and a moving vehicle on which a receiving means for receiving said first and second identification informations is mounted and which can round said cart route, in which said method is characterized in that said moving vehicle on which a retrieval means is mounted is moved along a cart route in said golf course, a judgement is made on receiving conditions by said repeaters or sensors on the basis of said first and second identification informations received by said receiving means, and lack or random order in said first and second identification informations can be displayed on the basis of judgement results.

According to a sixth aspect of this invention, there is provided with a retrieval method for a golf links operation-management system of the fifth aspect of this invention in which identification number of said first and second identification informations can be selectively displayed as said receiving conditions.

According to a seventh aspect of this invention, there is provided with a retrieval method for a golf links operation-management system of the sixth aspect of this invention in which required vice output is performed corresponding to said receiving conditions on the basis of said judgement results.

According to this invention, the receiving conditions of the identification informations transmitted from the sensors or repeaters can be measured by moving a moving vehicle such as a cart on which a retrieval apparatus for operation-management is mounted. And according to this invention, since the aforementioned receiving conditions can be informed by, for example, a given display form, voice output and so forth, sensors or repeaters the receiving conditions of which are not good can be easily differentiated.

BRIEF DESCRIPTION OF THE DRAWINGS

For a more complete understanding of this invention may be had to the following detailed explanations in connection with the accompanying drawings, in which.

DESCRIPTION OF THE PREFERRED EMBODIMENTS

Preferred embodiments of this invention are described below.

Figure 3:
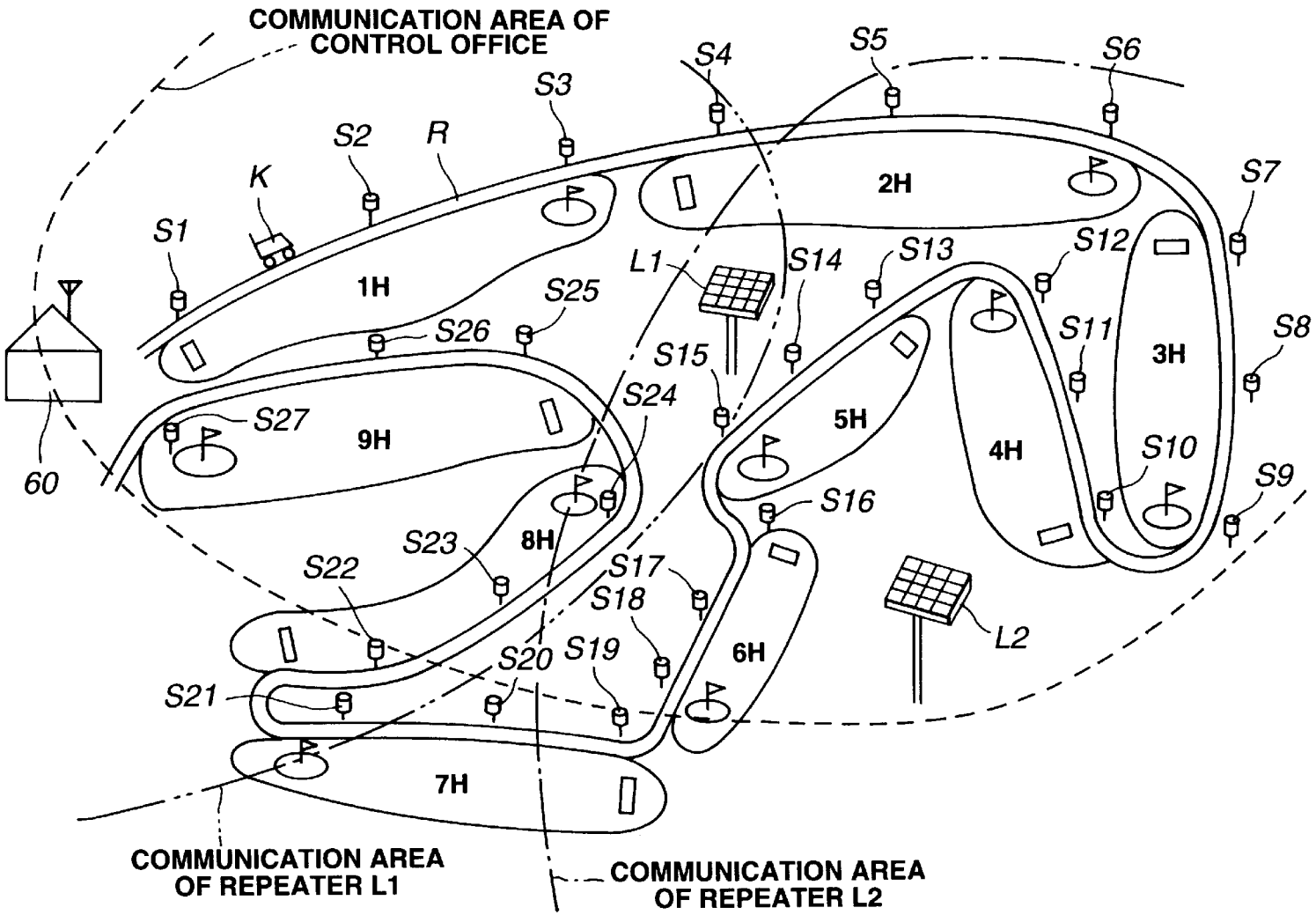
FIG. 3 is a schematic view showing each example of a layout and communication areas of repeaters.

First, an example of layout of a golf links is described referring to FIG. 3. FIG. 3 shows, for example, A course (hole No. 1 . . . 1H~9H) of plural golf links structured in said golf links.

A cart route R arranged along each hole is formed so that the cart K as a moving car (hereinafter referred to as cart) which is operated by a player for self-play, that is to say, in order to play by himself can pass thereon. A receiving means of weak radio wave for communicating with the sensor S described later and a receiving means of specific small power for communicating with the repeater L described later are mounted on the cart K.

Sensors S1~S27 as transmitting means of weak radio wave which can transmit a position identification information are placed at given positions of the cart route R, for example, shoulder. The setting positions of the sensors S (1~27) may be in the vicinity of teeing ground, fairway, green and so forth of each hole.

That is to say, when the cart K moves on the cart route R to the position in the vicinity of teeing ground, fairway, green where the sensor R is placed, the cart K can receive the position identification information transmitted from the sensor S. The area within which each sensor S can perform communication is area involving the cart route R including the sensor S as the central part of the area as shown by broken lines in FIG. 4. Since an example in which the sensor S can perform communication normally is described in FIG. 4, when the cart K moves from hole No. 1 to hole No. 9 along route of the cart route R, the position identification informations from the sensors S1 to S27 can be obtained in sequence.

The position identification information transmitted from the sensor S includes, for example, a sensor ID set in each sensor S individually or information on the position at which the said sensor S is placed on the course and so forth.

As shown in FIG. 3, repeaters, for example, two repeaters L1 and L2 are placed at the given position in the golf links in this example. The repeaters L1 and L2 are set as means for relaying, respectively, when the position identification information of the sensor S received by the cart K is transmitted for example from the cart K to the control office 60. That is to say, the communication areas of the repeaters L1 and L2 take responsibility for the given area on the course as shown by a one-dot chain line and a two-dot line, respectively and simultaneously, can cover almost the communication area of the control office 60 shown by a broken line.

The repeaters L1 and L2 receive a trigger signal from the control office 60 in the given period and perform communication with the cart K corresponding to the trigger signal received. Therefore, the repeaters L1 and L2 receive the trigger signal from the control office 60, and simultaneously, transmit the trigger signal for instructing the start of communication to the cart K. And, at this time, the repeater ID is transmitted as an identification information for the repeaters L1 and L2.

Accordingly, in the case as shown in FIG. 3, the cart K which moves on the cart route R is situated almost in the communication area of either the repeater L1 or repeater L2 or both of them and can perform communication with the control office 60. The area on the cart route R in which the cart K can not perform communication with the repeaters L1 and L2 is described later more in detail.

As described above, this invention is constructed so as to distinguish sensors or repeaters L1 and L2 which can not perform communication satisfactorily with the cart K from the sensors S (1~27) and the repeaters L1 and L2 and to inform them. Accordingly, this invention is constructed so as to mount a retrieval apparatus as described in FIGS. 1 and 2 on the cart K and to move the retrieval apparatus mounted-cart K, for example, by making round of the cart route R having nothing to do with golf play to detect the communication conditions.

Figure 1:
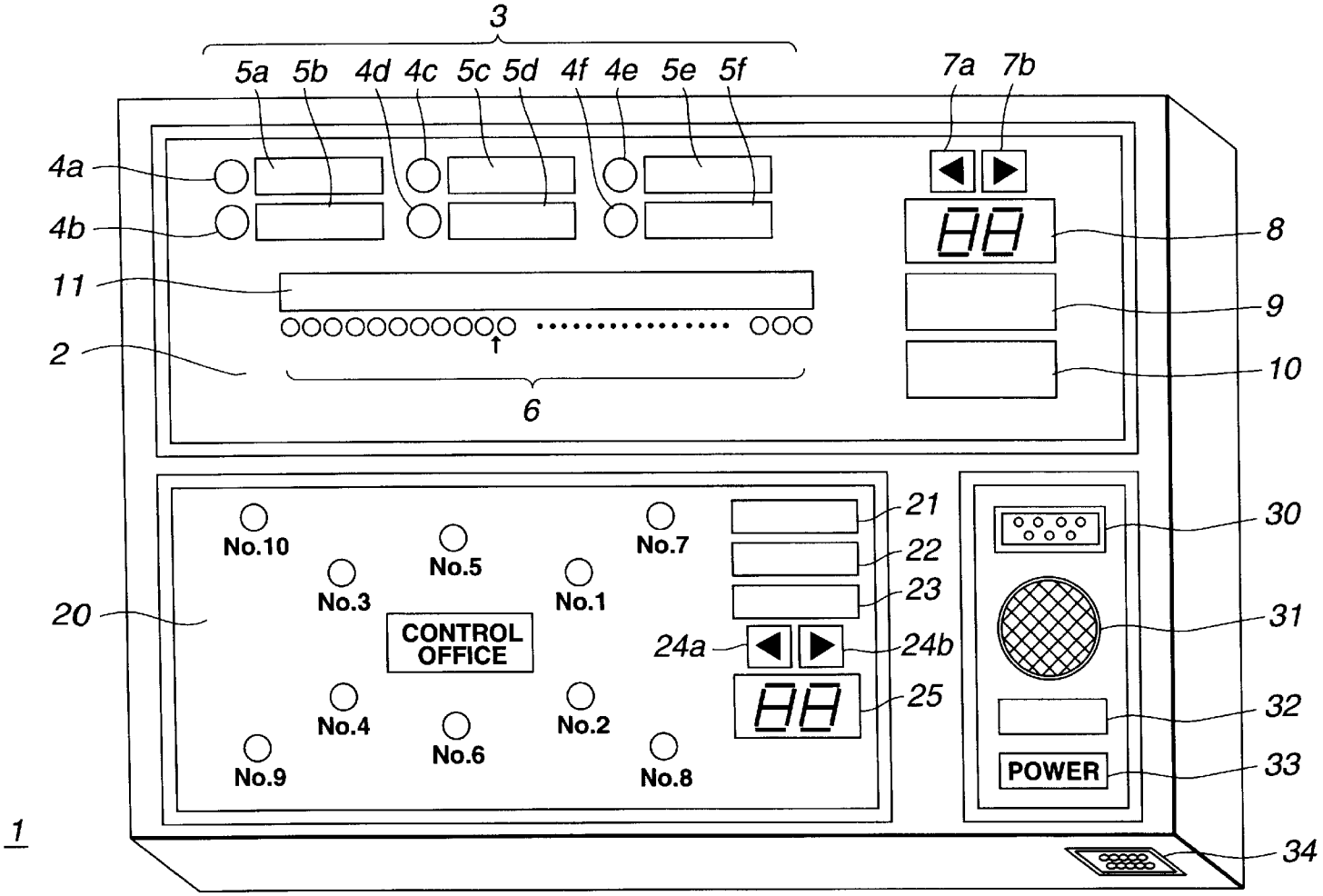
FIG. 1 is a sketch showing an exterior appearance of a retrieval apparatus of an example of this invention.

FIG. 1 is a sketch showing an exterior appearance of a retrieval apparatus for golf links operation-management system (hereinafter referred to as retrieval apparatus) of this example. The retrieval apparatus 1 shown in FIG. 1 is constructed, for example, so as to be portable, and is mounted on a moving vehicle, for example, cart when carrying out retrieval.

The retrieval apparatus 1 is provided with a controlling part which can be controlled by a user and sensors, a display part which can inform measurement results, a speaker and so forth on an upper face of a box.

A sensor measurement part 2 is provided with a control part for measuring the sensor S shown in FIG. 3 and an informing means. A course selection part 3 is provided with a memory switch 4(*a*~*f*), a course name indicating part 5(*a*~*f*). With respect to the memory switch 4 and the course name indicating part 5, those to which the same letters (*a*~*f*) are attached are corresponding to each other.

A sticker in which a course name is inscribed is stuck on a course name indicating part 5 or course name is written to the course name indicating part 5, and the specific course constructed in the golf links is allocated to the course name indicating part 5. Since it is assumed that a course of "A course" is constructed in the case as shown in FIG. 3, "A course" is allocated, for example, to the course name indicating part 5*a*.

A memory switch 4*a* is placed for a switch to store the measurement results of, for example, "A course" corresponding to the course name indicating part 5*a*. That is to say, a memory (described later) having storage regions each corresponding to six memory switches 4(*a*~*f*) is placed in this example. For example, as described later, when the cart K on which the retrieval apparatus 1 is mounted has finished running the cart route R and the switch 4*a* is actuated in a state of termination of measurement, the measurement results of "A course" are stored in a storing region corresponding to the memory switch 4*a*.

When the measurement results are stored in such a manner as described above, the memory switch 4*a* is a selection operation element for the measurement results and the measurement results of "A course" can be obtained by operating the memory switch 4*a*. That is to say, if the measurement results are stored, for example, at every course and, for example, the measurement results are input to a computing apparatus installed in the control office 60 after measurement, it is able to monitor by means of a monitoring apparatus of the computing apparatus. In other words, operation conditions of the cart K which are actually detected in the control office 60 can be compared with the measurement results of the retrieval apparatus 1. The memory switch 4(*b*~*f*) and the course name indicating part 5(*b*~*f*) are constructed similarly to the memory switch 4*a* and the course name indicating part 5*a*. Therefore, the memory switch 4(*b*~*f*) are allocated to each course before the measurement of the sensor.

For example, plural light emitting diodes (hereinafter referred to as LED by its initial letters) are arranged in the measurement results display part 6. These LED are arranged as informing means for displaying the measurement results of each sensor and can perform selectively lighting of each color in "green", "yellow", "red". Accordingly, a user can identify the measurement results of sensor by color of lighting.

Control of the lighting of LED can be performed in real-time while the measurement of sensor is carried out, however the measurement results with respect to all of the holes are on the basis of informations which are obtained by termination of measurement.

The selection keys 7*a*, 7*b* are set as operating keys to select numbers indicating the sensor ID in the sensor ID display part 8. As the measurement results in the case where the cart K runs the cart route R, sensor ID received by the cart K is stored in turn. Therefore, if the selection key 7*a* is operated when the sensor ID is selected in descending order and if the selection key 7*b* is operated when the sensor ID is selected in ascending order, numbers are displayed in the sensor ID display part in transition on the basis of the measurement results. For example, in the case where numbers "1", "2" and "3" are stored as the sensor ID, the sensor display part 8 displays in transition of "1", "2" and "3" by operating the selection key 7*b*. By the way, number to which " " is attached is explained as number corresponding to the sensor ID in the present specification.

The sensor ID display part 8 is constructed so as to be able to perform segment display by, for example, a phosphor displaying tube and so as to be able to display the number corresponding to the sensor ID selected by the selection keys 7*a*, 7*b*.

The measurement starting key 9 is a key for instructing to mount the retrieval apparatus 1 on the cart K to start the measurement of the sensor. That is to say, the retrieval apparatus 1 detects input of the measurement starting key 9 and changes to a measurement mode to start a measurement process. And, the measurement termination key 10 is an operation key for instructing the measurement of sensor which is now carrying out.

In the case where the storage of the measurement results by the memory switch 4(*a*~*f*) is performed at the time of termination of measurement, which may be performed, for example, immediately after operation of the measurement termination key 10. Therefore, when the measurement termination key 10 has been operated, an input operation of the memory switch 4(*a*~*f*) corresponding to the said course is performed.

The memorandum area 11 is placed corresponding to the measurement results display part 6 and is constructed so as to note matters relating to the measurement as memoranda.

The repeater measurement part 20 is provided with, for example, LED (No. 1~No. 10) corresponding to the repeater L placed in the golf links including the control office as a central part of the golf links. In the example shown in this Figure, the repeater measurement part 20 is constructed so as to correspond to ten repeaters.

The measurement starting key 21 is a key for instructing to mount the retrieval apparatus 1 on the cart K to start the measurement of the sensor. That is to say, the retrieval apparatus 1 detects input of the measurement starting key 21 and changes a mode to a measurement mode to start a measurement process. And, the measurement termination key 22 is an operation key for instructing the measurement of sensor which is now carrying out.

In the repeater measurement part 20, when the measurement starting key 21 is actuated and a mode is changed to a repeater measurement mode, the LED corresponding to the repeater which could perform communication lights up.

That is to say, in the case where the measurement by the repeater starts and normal communication is performed, there occurs a state that more than one of LED of No. 1~No. 10 light up.

The memory key 23 is an operation key for storing the measurement results by the repeater. By operating the memory key 23, the measurement results by the repeater are stored in a given region of a memory described later. That is to say, the measurement results by the repeater which are stored can be input in the computing apparatus installed in the control office 60 similarly to the measurement results by the sensor.

The selection keys 24*a*, 24*b* are set as operation keys for selecting numbers indicating the repeater ID in the repeater ID display part 25.

As the measurement results by the repeater in the case where the cart K runs the cart route R, the repeater ID received by the cart K is stored in turn. Accordingly, if the selection key 24*a* is operated when the repeater ID is selected, for example, in descending order and if the selection key 24*b* is operated when the repeater ID is selected, for example, in ascending order, numbers are displayed in the repeater ID display part 25 in transition on the basis of the measurement results. And, in the case where the communication-impossible area is detected, it is also possible to display the sensor ID (described later) corresponding to the said communication impossible area.

And, the repeater ID display part 25 is constructed, similarly to the sensor ID display part 8, so as to be able to perform segment display by, for example, a phosphor displaying tube and so as to be able to display the numbers corresponding to the repeater ID selected by the selection keys 24*a*, 24*b*.

The connector 30 is set as a terminal which can be connected to, for example, a receiving means mounted on the cart K, (for example, specific small power, weak radio wave) and data such as the sensor ID, the repeater ID and so forth are supplied via the connector 30.

The speaker 31 is set as an informing means similarly to the LED, and can output the required voice message as the measurement results by the sensor or repeater.

The data load switch 32 is an operation terminal for supplying the measurement results stored in the memory in the retrieval apparatus by means of the memory switch 4(*a*~*f*) or the memory key 23 into an external apparatus, for example, a computing apparatus.

The power source key 33 is a power switch for the retrieval apparatus 1 and the data port 34 is a terminal for supplying the measurement results into an external apparatus, for example, a computing apparatus and so forth in the case where the data load switch 32 is operated and is constructed as a sequential-data port known as, for example, RS-232.

Since the retrieval apparatus 1 is constructed in a single body, it can be mounted on the cart K only when the measurement is carried out, and therefore, it can be removed from the cart K, for example, at the time of play when the measurement is not carried out.

Figure 2:
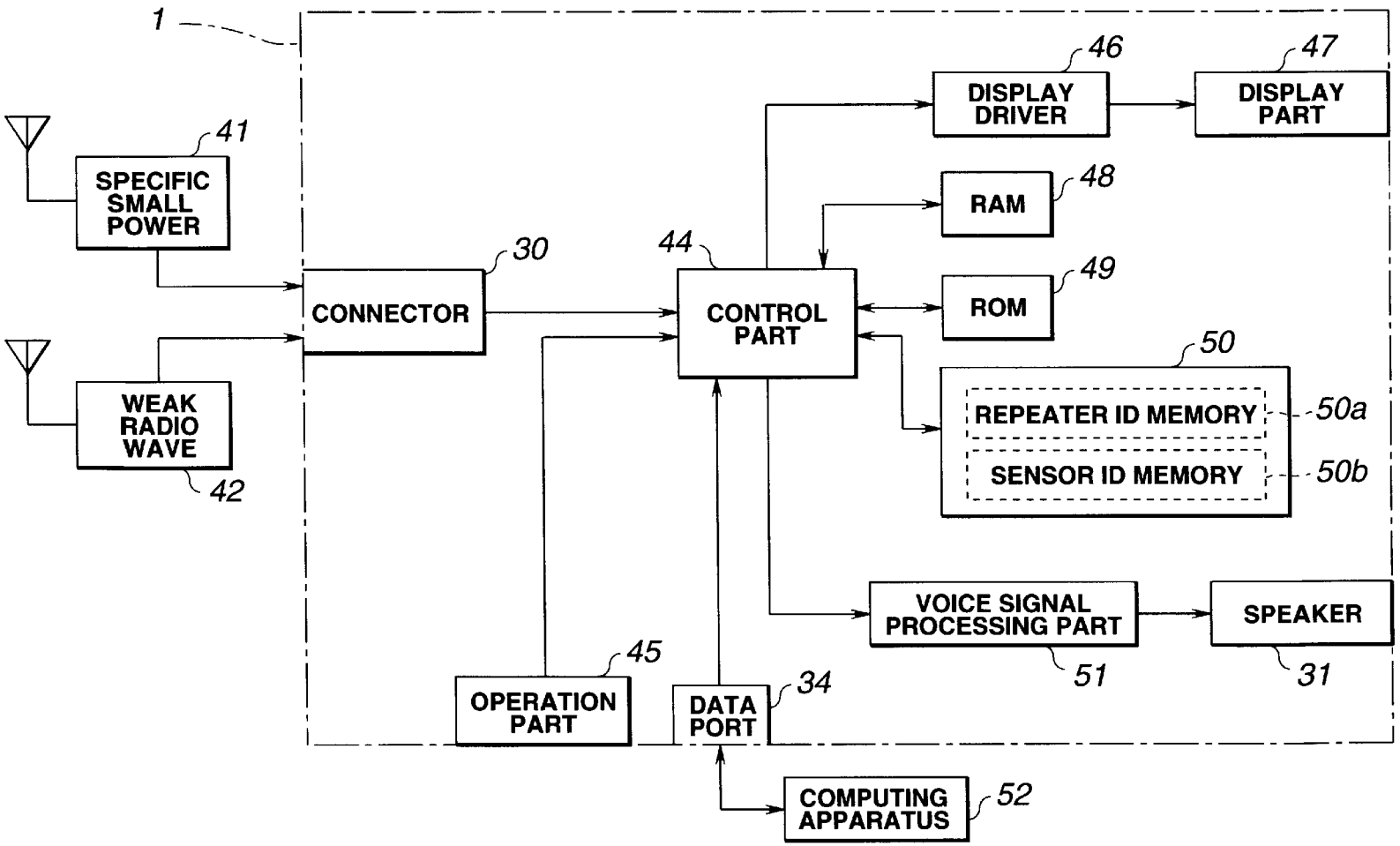
FIG. 2 is a block diagram explaining a functional structure of a retrieval apparatus of an example of this invention.

FIG. 2 is a block diagram explaining a functional structure of the retrieval. In FIG. 2, the same marks are numbered to the same parts as those of FIG. 1. The operation part 45 is shown as that corresponding to the memory switch 4(*a*~*f*), the selection keys 7*a*, 7*b*, the selection starting key 9, the measurement termination key 10, and the measurement starting key 21, the measurement termination key 22, the memory key 23, the selection keys 24*a*, 24*b*, and data load key 32, the power key 33. Accordingly, an operation input signal corresponding to each operation key is output from the operation part 45.

The display part 47 is shown as that corresponding to the measurement results display part 6, the sensor ID display part 8 and the repeater ID display part 25.

The receiving part 41 is a receiving means for specific small power mounted on the cart K, and is constructed so as to receive, for example, a trigger signal and the repeater ID from the repeater L. And, the receiving part 42 is a receiving means for weak radio wave mounted on the cart K, and is constructed so as to receive, for example, the sensor ID from the sensor S. And, the receiving parts 42, 43 are constructed so as to be connected to the connector 30, and the sensor ID and the repeater ID which are received by the receiving parts 41, 42 are supplied to the retrieval apparatus 1 through the connector 30.

The sensor ID, repeater ID, trigger signal and so forth (which are hereinafter called as generic term "received informations") are supplied to the control part 44.

The control part 44 commands the display driver 46 and the voice signal processing part 51 on the basis of the received informations supplied or an operation input signal supplied from the operation part 45 to perform the required control and, simultaneously, stores the aforementioned received informations in RAM 48.

The display driver 46 controls lighting of each LED constructed as the display part 47 and segment display at the sensor ID display part 8 and the repeater ID display part 25 on the basis of the instructions from the control part 44.

RAM (Random Access Memory) 48 is constructed as a buffer memory and constructed as a buffer area in which the received informations are stored in turn or a work area in the case where the past measurement results are read.

A program by which the control part 44 performs the required process and the required voice data and so forth are stored in ROM (Read Only Memory) 49, which can be read, if necessary.

The receiving memory 50 is constructed from a storage area comprising the repeater ID area 50*a* and the sensor ID area 50*b*.

The received informations are stored in these areas as the measurement results. That is to say, the received informations are stored in RAM 48 in turn while measurement is performed, however the received informations stored in RAM 48 are stored in the memory 50 in the case where the measurement terminates and operations of the memory switch 4 and the memory key 23 are detected.

The measurement results (the repeater ID and the required sensor ID described later) stored in RAM 48 are stored in the repeater area 50*a* constructed in the receiving memory 50 when the memory key 23 is actuated after termination of the measurement after finish of the measurement by the repeater.

Plural storage areas corresponding to the memory switch 4(*a*~*f*) are set in the sensor ID area 50*b*, and the measurement results (sensor ID) stored in RAM 48 are stored in area corresponding to the memory switch 4*a* (A course) in the sensor ID area in the case where, for example, the memory switch 4*a* is actuated after the termination of the measurement by the sensor. And, in the case of reading the measurement results after the termination of the measurement, the measurement results corresponding to the memory switch 4*a* (A course) can be read from the said area by operating the memory switch 4*a* and is stored in RAM 48.

In the case of outputting the measurement results (repeater ID, sensor ID) to the computing apparatus 52 of an external apparatus, the measurement results stored in the receiving memory 50 (repeater ID area 50*a*, sensor ID area 50*b*) are read corresponding to the operation of the data load switch 32 and supplied to the computing apparatus 52 through the data port 34.

The voice signal processing part 51 is constructed so as to perform the required voice output process on the basis of the measurement results. The voice data supplied to the voice signal processing part 51 is stored in, for example, ROM 49, and the control part 44 selects the required voice data on the basis of the measurement results and supplies to the voice signal processing part 51. A voice signal is generated in the voice signal processing part 51 on the basis of the voice data supplied, which is then supplied to the speaker 31, thereby, the measurement results can be output as voice from the speaker 31.

An explanation is given below on an example in which the measurement by the sensor S is performed.

Figure 4:
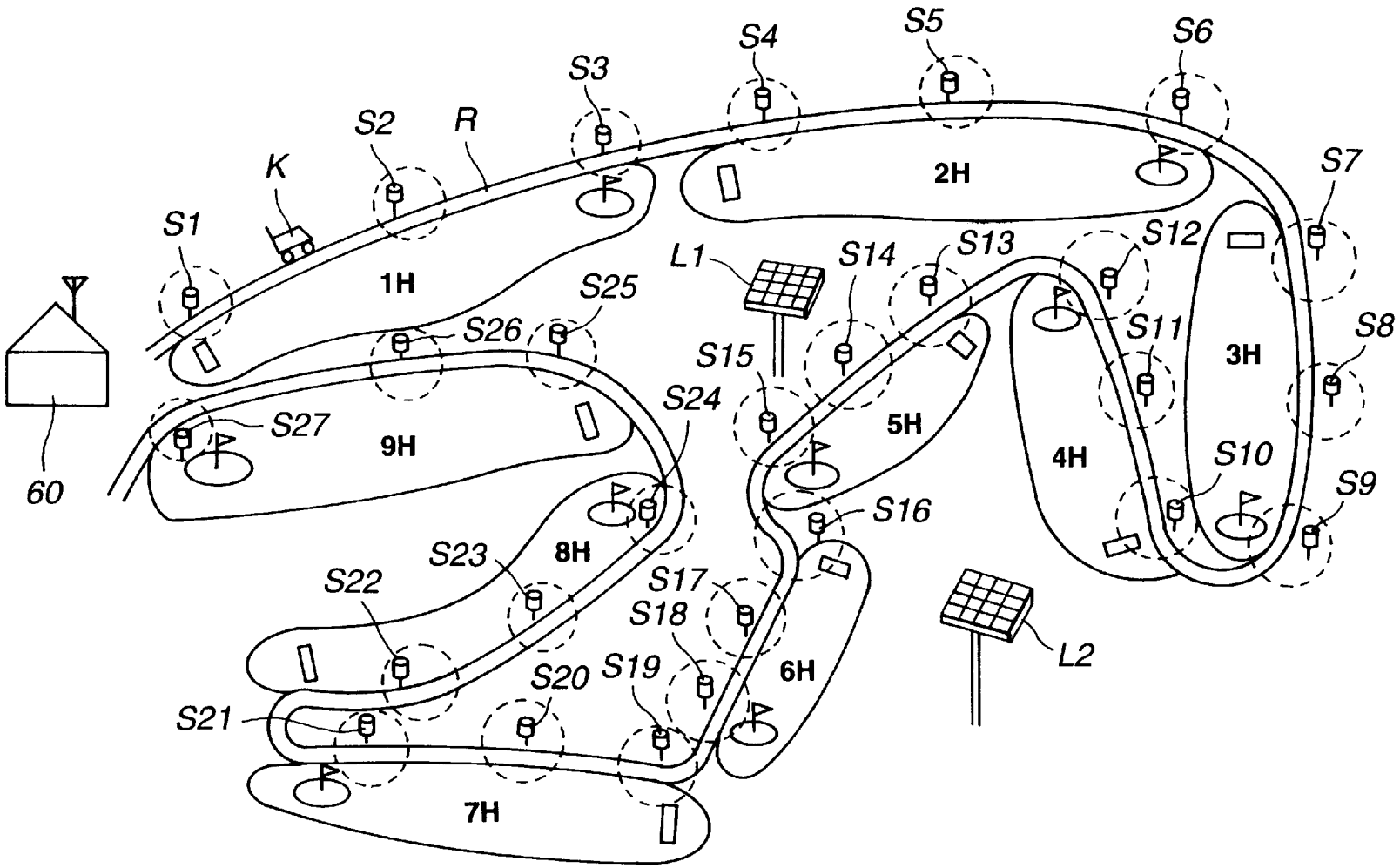
FIG. 4 is a schematic view showing an example of normal communication areas of sensors.

For example, in the case where the sensor S is measured in "A course" shown in FIG. 4, the order of the sensor ID to be detected is "1", "2", "3" . . . , "27". This is normal measurement results, and in the retrieval apparatus 1 shown in FIGS. 1 and 2, a control is taken in which every LED arranged in the measurement results display part 6 lights up in green color indicating normal result.

Figure 5:
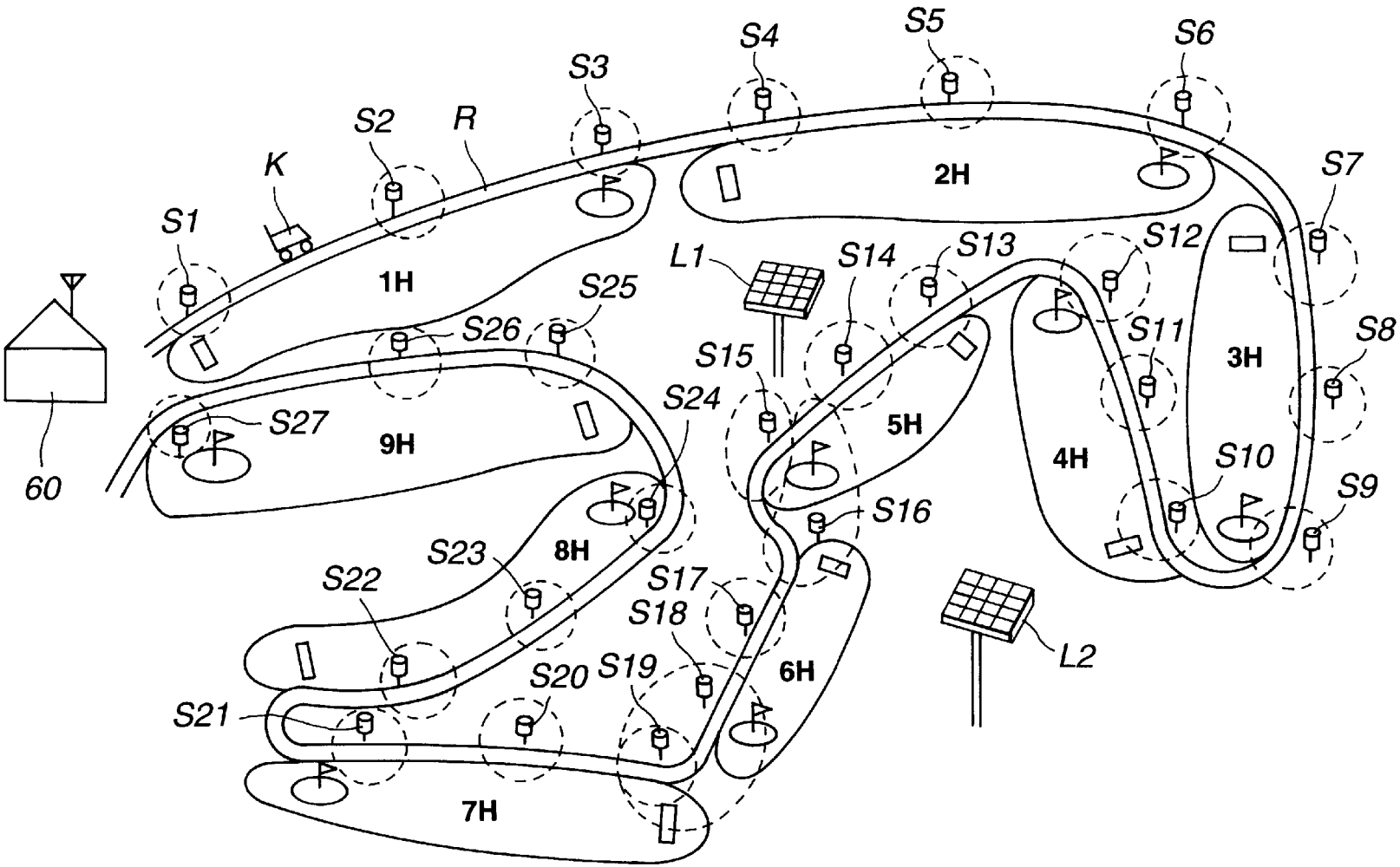
FIG. 5 is a schematic view showing an example of abnormal communication areas of sensors.

However, as shown in FIG. 5, for example, in the case where the communication area of the sensor S 16 extends to two places on the cart route R, the order of the sensor ID to be detected is "14", "16", "15" "16", "17" . . . , when the cart K passes through the neighborhood. In the case where two communication areas overlap in part each other as shown in the sensors S18 and S19, the result of detection by the sensor ID in the overlapped area is eventually that two kinds of sensor ID are received alternately, like "18", "19", "18", "19" . . . corresponding to timing when the cart K and the sensor S perform communication.

In such a case as described above, according to this invention, it is able to inform in different colors, for example, by controlling lighting color of LED in the measurement results display part 6 that the sensor ID does not receive in normal order.

Figures 6A, 6B:
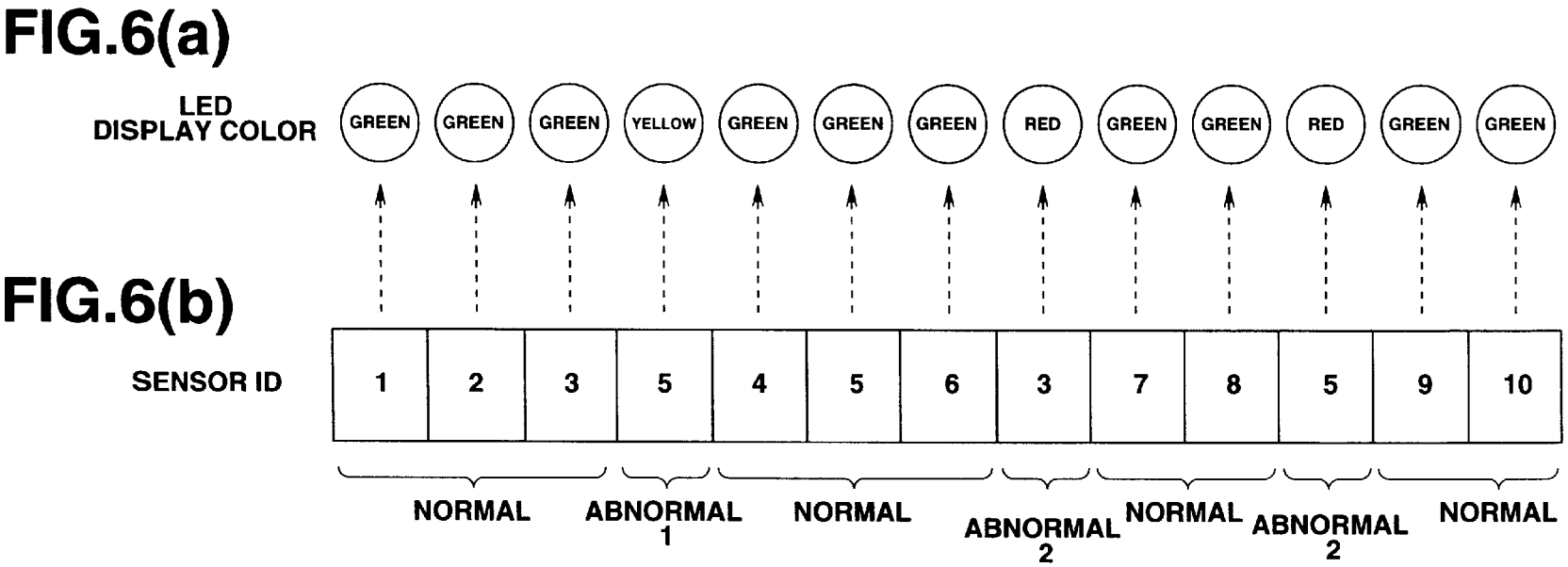
FIG. 6 is a diagram explaining an example of control of lightning of LED corresponding to sensor ID detected by a retrieval apparatus.

In FIG. 6, the order of the sensor ID detected during measurement is 13, that is, "1", "2", "3", "5", "4", "5", "6", "3", "7", "8", "5", "9", "10" as shown from the left of FIG. 6. That is to say, the sensor ID is stored in RAM 48 in order shown in FIG. 6.

In this case, "1", "2" and "3" are considered to be normal measurement results, and green color lamps are turned on. Since, however, the fourth sensor ID is not normal order because of being "5", a judgement is made that the order is reverse and a yellow color lamp is turned on with respect to the fourth LED from the left (abnormal).

While the fifth sensor ID is "4", since it is sensor ID which should be detected intrinsically immediately after "3", a green color lamp is turned on.

The sixth and the seventh sensor ID are "5" and "6", respectively. In this case, since the order of "4", "5" and "6" is normal measurement results, a green color lamp is turned on to each of them.

While the eighth sensor ID is "3", since the order is not normal and, in addition, "3" has been previously detected, for example, a red color lamp is turned on (abnormal 2).

Further, the ninth and tenth sensor ID are normal. While "5" is detected again in the eleventh, a red color lamp is turned on for the same reason as that for "3" which is the eighth sensor ID. And, the ninth and tenth sensor ID are also normal.

In such a manner as described above, the receiving condition of the sensor ID can be informed by changing selectively lighting color of LED according to the result of detection.

Furthermore, in the case where a user wishes to grasp a detailed order of the sensor ID received, the sensor ID shown in FIG. 6(*b*) is displayed in the sensor ID display part 8 in turn in ascending order or in descending order by operating the selection keys 7*a* and 7*b* shown in FIG. 1.

In such a manner as explained above, while the sensor ID can be measured, the communication with the control office should be normally performed through the repeater L after detection by the sensor ID.

Next, an explanation is given below on an example in which the repeater L is measured.

In the example shown in FIG. 3, two repeaters L1 and L2 are placed and the communication areas of the repeaters L1 and L2 cover nearly the whole area of the said course (A course) as previously described. And, the communication area of the control office 60 also covers nearly the whole area of the said course. Accordingly, when the cart K runs the cart route R, the communication with either the repeater L1 or repeater L2 or with both of them can be invariably performed.

However, for example, the cart route R near the sensor S20 on No. 7 hole which is enclosed with one-dot line and two-dot line in FIG. 3 is out of the communication areas of the repeaters L1 and L2. In this case, even if the communication between the cart K and the sensor S20 is normal, an erroneous operation condition is transmitted to the control office, if the communication with the repeater L1 or repeater L2 is abnormal.

Therefore, the retrieval apparatus 1 is constructed so as to measure whether or not the cart K can receive a trigger signal which is transmitted from the repeater L in constant period and instructs the start of communication.

For example, in the case where the cart K runs the cart route R as shown in FIG. 3, the following communications can be performed, that is to say, communication between the sensor S1~sensor S4 and the repeater L1, communication between the sensor S5~sensor S14 and the repeater L2, communication between the sensor S15 and the repeater L1 and L2, communication between the sensor S17~sensor S19 and the repeater L2, communication between the sensor S21~sensor S23 and the repeater L1, communication between the sensor S24 and the repeaters L1 and the repeater L2, and communication between the sensor S25~sensor S27 and the repeaters L1.

That is to say, when the measurement by the repeater starts, the retrieval apparatus 1 receives a trigger signal from the repeater L1 or repeater L2, and stores the repeater ID transmitted almost simultaneously. And, when the trigger signal can not be received, a judgement is made that the communication with the repeater L1 and repeater L2 can not be performed at the position where the cart K is now present for any reasons. For example, while the communication with the repeater L1 and repeater L2 can not be performed in the vicinity of the sensor S20 as previously described, in this case, the retrieval apparatus 1 stores the sensor ID of the sensor S19 which could communicate through the repeater L2 immediately before the sensor S20, as data showing communication-impossible area in RAM 48 as the measurement results. If the measurement is further carried out continuously, the cart K can communicate with the sensor S21, and simultaneously, can receive the trigger signal of the repeater L1. That is to say, at this point, the communication conditions is normal.

Accordingly, as the measurement results by the retrieval apparatus 1, a judgement can be made that there occurs a state that the communication is impossible between the sensor S19 and sensor S21 and that the communication with the repeater L1 and repeater L2 can be carried out outside the area between the sensor S19 and sensor S21. When a mode is moved to a repeater measurement mode in the retrieval apparatus 1, LED corresponding to the repeater which is now communicating is turned on in the repeater measurement part 20. For example, when LED No. 1 and LED No. 2 correspond to the repeater L1 and repeater L2, respectively, LED No. 1 is turned on in the communication area of the repeater L1 and LED No. 2 is turned on in the communication area of the repeater L2. And, neither LED No. 1 nor LED No. 2 is turned on in the vicinity of the sensor S20, thereby, it can be grasped that the region in the vicinity of the sensor S20 is communication-impossible area.

Further, since the communication with the control office 60 is impossible in such a communication-impossible area, the retrieval apparatus 1 may be constructed so as to inform impossibility of communication by voice in situ on the basis of the measurement results, and thereby, a measurer who operates the cart K can be confirm in situ the general position.

Further, as shown in FIG. 3, it is assumed that there occurs a communication-impossible area for reason that each of the repeater L1 and repeater L2 does not operate normally per se, that is to say, there occur obstacles to the repeaters themselves for any reasons.

In such case as described above, the trigger signal can not be for relatively long time from the start of measurement. Therefore, it is advisable that a judgement is made that communication is impossible because of trouble with the repeater itself in the case where receiving of trigger signal can not be detected within the given time.

While the repeater ID of the repeater L which can perform communication and the sensor ID which corresponds immediately before communication-impossible area are stored in RAM 48 during measurement, the measurement results stored in RAM 48 is stored in the repeater ID area 50*a* by operating the memory key 23 at termination of measurement by operating the termination key 22. By the way, while only one communication-impossible area is shown in the vicinity of the sensor S20 in the example described in FIG. 3, in the case where a large number of communication-impossible areas is actually found, the sensor ID corresponding to them is stored in RAM 48 in turn.

The measurement results stored in the repeater ID area 50*a* (repeater ID, sensor Id corresponding to communication-impossible area) can be read by selecting the selection keys 24*a*, 24*b* and can be displayed in the repeater ID display part 25.

That is to say, since the repeater ID display part 25 displays the sensor ID in the vicinity of the communication-impossible area in turn in the case where the communication-impossible area is detected, detailed informations on the communication-impossible area can be obtained.

When there occurs the communication-impossible area due to the repeater, not only there occurs an error in operation-management for play, but also the cart K present in the region is in a state of being isolated from the control office 60, and, therefore, the communication with the control office is impossible, even if any accidents happen on play. If, however, the communication conditions are measured by means of the retrieval apparatus 1 previously, for example before start of play, maintenance can be carried out on the basis of the measurement results and good communication conditions can be obtained.

Figure 8:
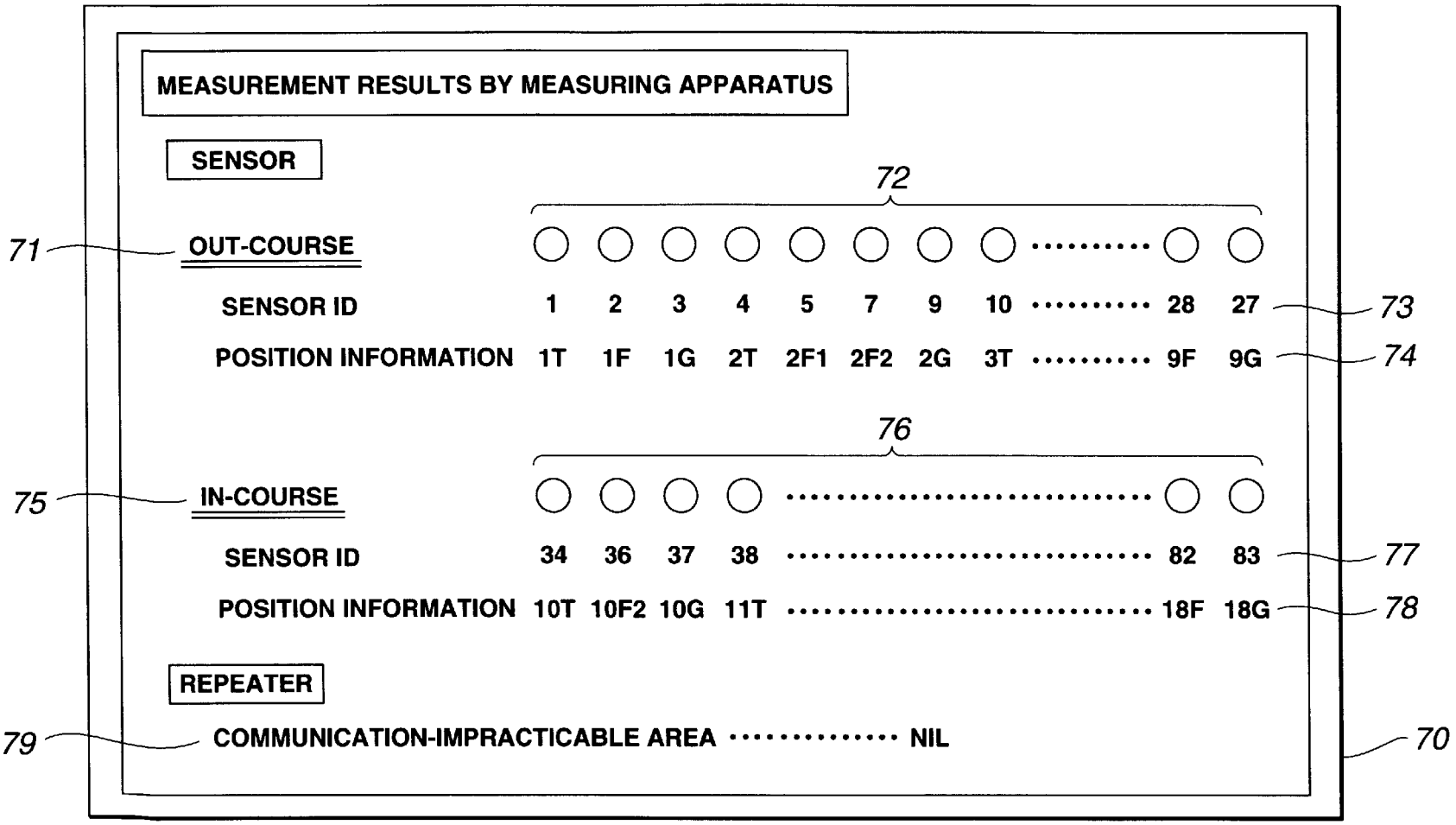
FIG. 8 is a diagram explaining a case in which measurement results by a retrieval apparatus are input to a computing apparatus to display in a form of window.

An example of processing of the control part 44 when the measurement is carried out in the retrieval apparatus 1 is explained schematically according to the flowchart shown in FIG. 8.

In the retrieval apparatus 1, in the case of not being in a repeater measurement mode (S001) which shows in this example the moment when the repeater measurement mode terminates, a judgement is made on whether or not the operation of the memory key 23 is detected (S002). And, when the operation of the memory key 23 is detected, the sensor ID detected in the vicinity of the communication-impossible area is stored in the repeater ID area 50*a* (S003).

In the case of being in a repeater measurement mode (S001), a detection is made on whether or not a trigger signal is generated in the given period from the repeater (S004). Then, when the trigger signal is not detected, the sensor ID received immediately previously is stored as the measurement results in RAM 48 (S005). The sensor ID received immediately previously is actually different from the sensor ID to be detected by measurement of the sensor at a step explained later, which is, however, now explained for convenience as a repeater measurement mode.

After storing in RAM 48 the data obtained by measurement, an information on, for example, communication-impossible area is output as information processing (S006) by voice message from a speaker 31. And then the step returns to step S004 to wait for input of trigger signal.

In the case where the trigger signal is detected at step s004 and a mode is in a sensor measurement mode (S007), a judgement is made on whether or not the sensor ID transmitted from the sensor S has been detected (S008). And when receiving of the sensor ID is detected, a judgement is made on whether or not the said sensor ID is different from that received previously (S009). And, when the judgement result here is "NO", which shows that the cart K is present in the communication area of the same sensor S, and in contrast, when the result of the judgement here is "YES", which shows that the cart K moves out of communication area of a certain sensor S and moves in communication area of another sensor S.

In the case where the sensor ID received at the step S009 is determined to be different from that previously received, a judgement is made on whether or not the sensor ID is in ascending order (S010). When the sensor ID is determined to be in ascending order, a control is taken that a given LED of the measurement results display part 6 is turned on, for example, in green (S011), which corresponds to "NORMAL" shown in FIG. 6(*b*).

In the case where the sensor ID received at the step S010 is determined to be not in ascending order, a judgement is made on whether or not the sensor ID is the same as that received previously (S012). When the said sensor ID is determined to be the same as that received previously, a control is taken that a given LED of the measurement results display part 6 is turned on, for example, in red (S013), which corresponds to abnormal 2 shown in FIG. 6(*b*).

When the sensor ID received is determined at the step S012 to be not the same as that received previously, a control is taken that the given LED of the measurement results display part 6 is turned on, for example, in green (S014), which corresponds to abnormal 1 shown in FIG. 6(*b*).

And, then the sensor ID is stored in RAM 48 as a buffer area (S015), and, thereby, the data which are obtained by measurement are stored in RAM 48 in turn.

A judgement is made on whether or not the memory switch 4(*a~f*) is input (S016). And, when the memory switch 4(*a~f*) is input, the measurement results by the sensor area stored at the sensor ID area 50*b* in the given area corresponding to either of the switch 4(*a~f*)(S017). And, in contrast, when the memory switch 4(*a~f*) is not input, an input of a trigger signal is waited (S004).

While storage of the measurement results in the receiving memory 50 at the step S005 and step S017 is explained above as a case where an input of the measurement termination key is detected, it can be carried out at any time during measurement.

By the way, when the measurement results thus obtained is supplied, for example, in the computing apparatus 52 installed in the control office 60 after termination of measurement to monitor, the retrieval apparatus 1 is connected with the computing apparatus 52 as shown in FIG. 2 and the data load key 32 is input.

Thereby, the measurement results can be displayed on a monitor of the computing apparatus 52, in a form of, for example, a window as shown in FIG. 8.

In FIG. 8, the window 70 is formed by the required image processing by the computing apparatus 52 in which the measurement results by the sensor and by the repeater are shown.

In the region showing the measurement results by the sensor, name of the course (A course) is shown in the course display part 71, and the color display region 72 corresponding to LED in the measurement results display part 6 of the retrieval apparatus 1, and the sensor ID display region 73, as well as the position in the course information (number indicates hole, attached letter "T" indicates teeing ground, "F" indicates fairway, "G" indicates green) region 74 are formed in the measurement results display part 72.

Similarly, the course display part 75, the color display part 76, the sensor ID display part 77 and the position information region 78 are formed.

Figure 7:
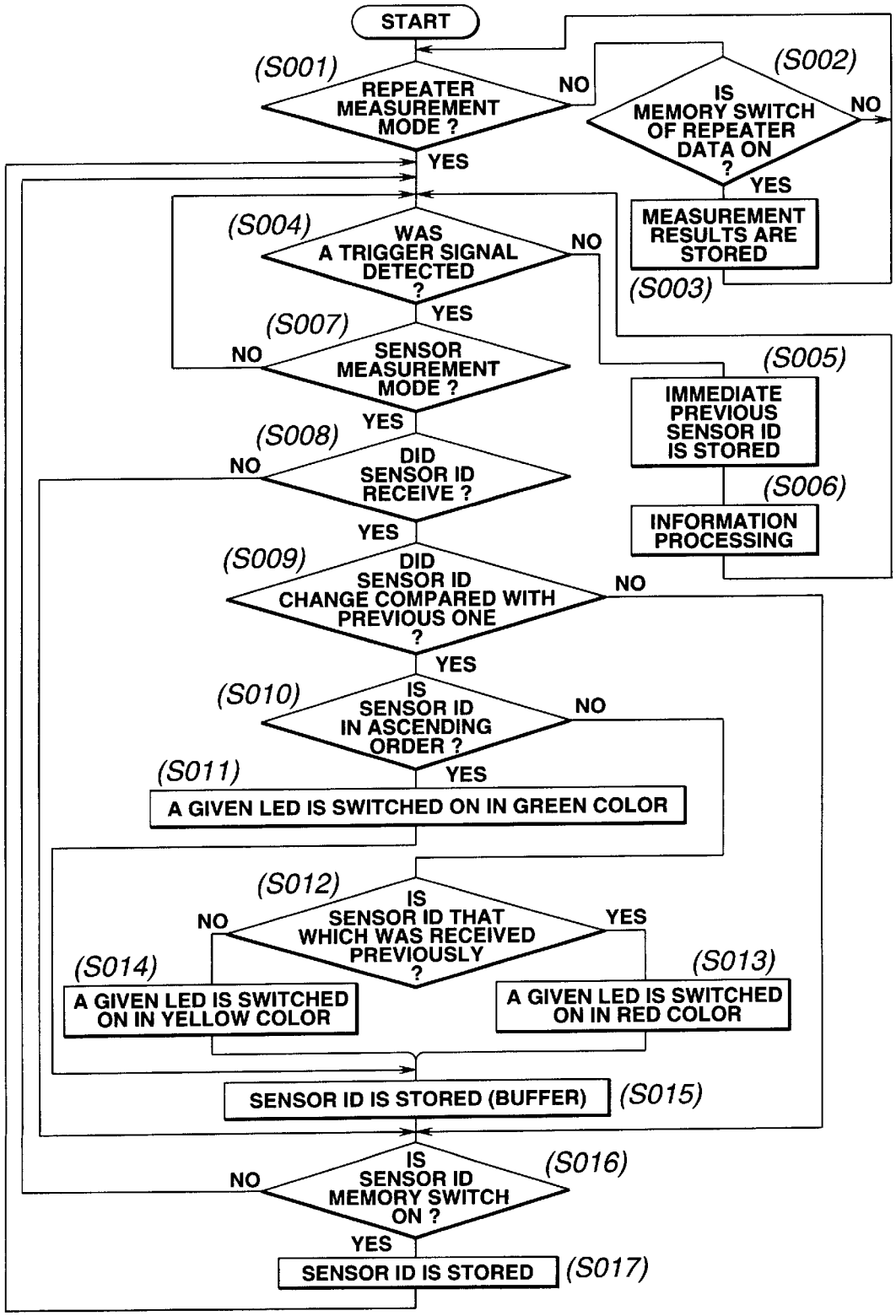
FIG. 7 is a flowchart explaining an example of measuring process of communication by a retrieval apparatus.

Further, the region showing the measurement results by the repeater is provided with the measurement results display part 79 showing the presence of the communication-impossible area. In the example shown in FIG. 8, it is assumed that the communication-impossible area is not present. However, in the case where the communication-impossible area is detected, it is advisable to display the sensor ID corresponding to the step S995 of the flowchart shown in FIG. 7.

As explained above, since the measurement results stored in the retrieval apparatus 1 can be supplied to the computing apparatus 52 of an external apparatus, it is possible that the retrieval apparatus 1 is constructed so that it is provided with not the display means such as LED, but only an operation means which is indispensable for the construction of the retrieval apparatus 1.

Figure 9:
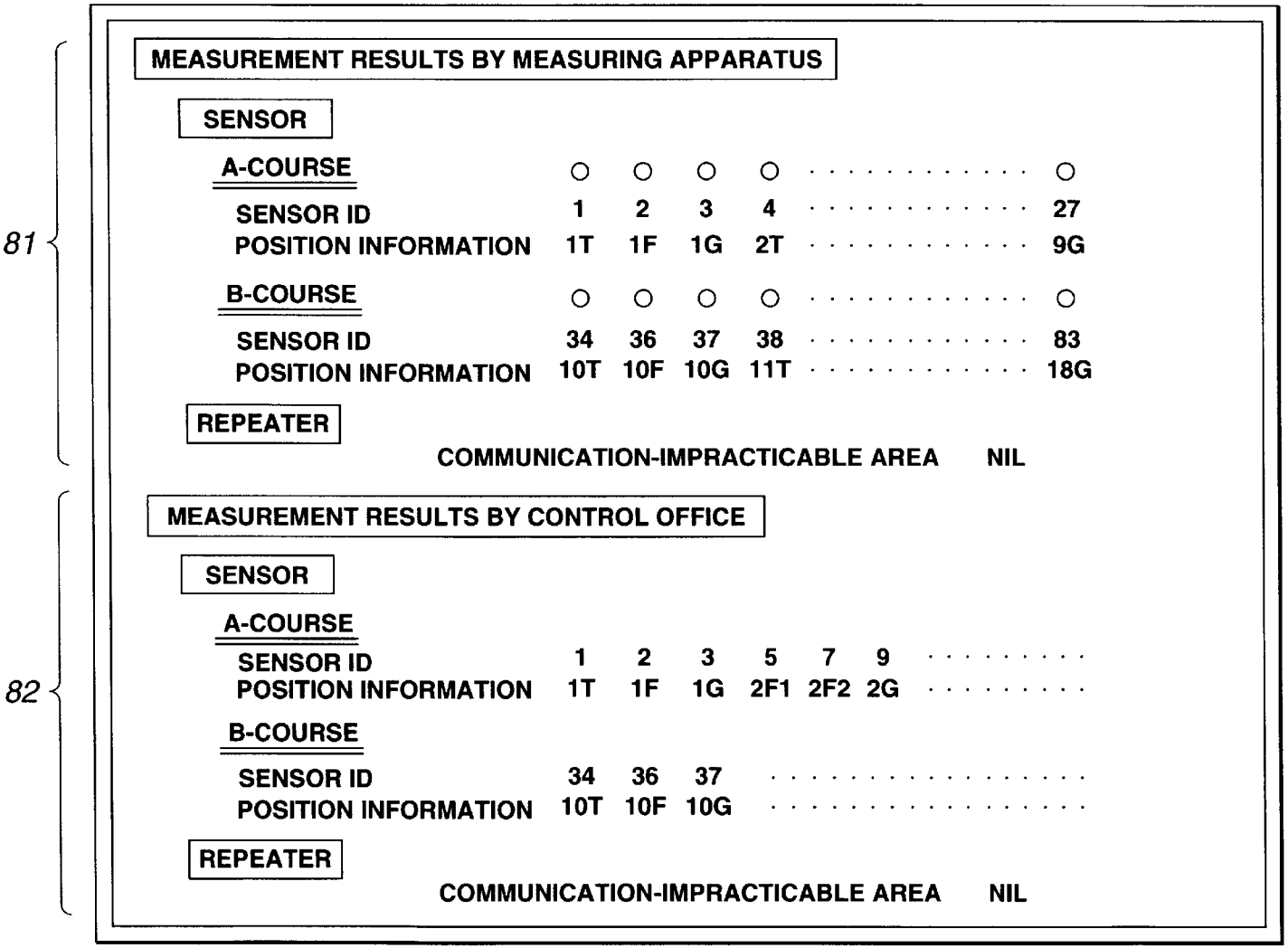
FIG. 9 is a diagram explaining a case in which measurement results by a retrieval apparatus and those by a computing apparatus are displayed in the same window.

In FIG. 8, an example is given in which only the measurement results by the retrieval apparatus 1 is displayed on the monitoring apparatus, it is possible as shown in FIG. 9 to display the measurement results by the retrieval apparatus 1 and that by the computing apparatus 52 on the same window 80 taking an advantage of making use of the computing apparatus 52 installed in the control office 60 into consideration.

In such case as described above, since the region 81 displaying the measurement results by the retrieval apparatus 1 and the region 82 displaying the measurement results by the control office are formed in the window 80, it is able to compare both of the measurement results. Thereby, more detailed informations can be obtained on the sensor the communication conditions of which is not good and on the communication-impossible area of the repeater L.

While an explanation is described in this working embodiment by giving one course (A course) in a golf links as an example, this invention is applicable to plural courses by using the memory switch 4(*a~f*) selectively in the retrieval apparatus 1. This is similar to the case where the measurement by the repeater is carried out.

While an explanation is described in this working embodiment by giving as an example a case where good communication conditions can be obtained by carrying out maintenance of existing sensors and the repeaters, this invention is also applicable to a case where setting positions for sensors and repeaters to be newly set are determined.

As described above, according to this invention, since a retrieval apparatus is mounted on a moving vehicle (cart), for example, a cart for riding which can communicate with a sensor, a repeater and so forth which are set on a golf course, and then the retrieval apparatus-mounted moving vehicle is moved on a cart route, the receiving conditions of identification informations transmitted from the aforementioned sensor and repeater can be judged. And, according to this invention, since the judgement results can be displayed, for example, on a display means which is able to select the required display form, a position can be easily grasped at which communication with the sensor, repeater and moving vehicle is not good in the golf links.

Further, according to this invention, more detailed receiving conditions can be grasped by displaying the aforementioned identification informations in number selectively.

Further, according to this invention, the receiving conditions can be informed more intelligibly by performing voice output corresponding to the aforementioned receiving conditions on the basis of the judgement results.

And, further, according to this invention, since the measurement results can be supplied to an external apparatus, for example, a computing apparatus and so forth, the communication conditions can be judged by comparing the operation conditions of the cart detected, for example, in the control office with the measurement results by the retrieval apparatus.

What is claimed is:

1. A golf course operation-management system comprising:

at least one repeater placed on a golf course and including a repeater ID transmitting apparatus configured to transmit a repeater ID;

a plurality of sensors arranged along a golf cart path at plural locations corresponding to at least a teeing ground, a fairway area, and a putting green of each hole of the golf course, each of said plurality of sensors including a sensor ID transmitting apparatus configured to transmit a sensor ID and to maintain communication between said at least one repeater and said plurality of sensors;

a receiver provided on a vehicle and configured to receive said repeater ID and said sensor ID from said at least one repeater and each of said plurality of sensors; and a retrieval apparatus mounted on said vehicle and including a control unit configured to process information data transmitted from said at least one repeater and said plurality of sensors based on the sensor ID and the repeater ID received by said receiver, a memory configured to store the information data processed by said control unit, and a display configured to indicate the information data relating to a sequential order of the sensor ID and the repeater ID transmitted from each of said plurality of sensors and said at least one repeater and received by said receiver.

2. The golf course operation-management system as defined in claim 1, wherein said memory outputs the information data stored in said memory to an external equipment.

3. The golf course operation-management system as defined in claim 1, wherein:

said at least one repeater and each of said plurality of sensors are assigned with an ID number; and the sequential order of the sensor ID and the repeater ID are displayed by the ID number on said display.

4. The golf course operation-management system as defined in claim 1, wherein said retrieval apparatus further includes an audio signal processing unit configured to produce an audible signal representing conditions of the information data transmitted from said at least one repeater and said plurality of sensors and received by said receiver.

5. A method of setting and operating a golf course operation management system which includes at least one repeater placed on a golf course, said at least one repeater including a repeater ID transmitting apparatus, a plurality of sensors arranged along a golf cart path at plural locations corresponding to at least a teeing ground, a fairway, and a putting green of each hole of the golf course, each of said plurality of sensors including a sensor ID transmitting apparatus configured to maintain communication between said at least one repeater and said plurality of sensors, comprising:

providing a vehicle with a receiver configured to receive said repeater ID and said sensor ID from said at least one repeater and each of said plurality of sensors, and a retrieval apparatus mounted on said vehicle;

actuating said plurality of sensors arranged along the golf cart path sequentially as said vehicle travels on the golf course and said at least one repeater placed on the golf course to generate sensor ID signals from said plurality of sensors and a repeater ID signal from said at least one repeater;

receiving the sensor ID signals and the repeater ID signal at said receiver on said vehicle;

processing conditions of the sensor ID signals and the repeater ID signal by said retrieval apparatus; and displaying a sequential order of the sensor ID signals and the repeater ID signal generated from said plurality of sensors and said at least one repeater as said vehicle travels on the golf course on a display included in said retrieval apparatus to provide information on a location of each of said plurality of sensors and a location of said at least one of repeater on the golf course.

6. The method of claim 5, wherein:

said at least one repeater and each of said plurality of sensors are assigned with an ID number; and the sequential order of the sensor ID signals and the repeater ID signal are displayed by the ID number on said display.

7. The method of claim 5, wherein said retrieval apparatus produces an audible signal representing conditions of the sensor ID signals and the repeater ID signal from each of said plurality of sensors and said at least one repeater.

* * * * *